US008305284B2

(12) United States Patent
Tai et al.

(10) Patent No.: US 8,305,284 B2
(45) Date of Patent: Nov. 6, 2012

(54) ANTENNA ASSEMBLY WITH THREE-DIMENSION CONNECTING ELEMENT

(75) Inventors: Lung-Sheng Tai, Tu-Cheng (TW); Po-Kang Ku, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 450 days.

(21) Appl. No.: 12/619,694

(22) Filed: Nov. 17, 2009

(65) Prior Publication Data

US 2010/0123639 A1 May 20, 2010

(30) Foreign Application Priority Data

Nov. 17, 2008 (TW) ..... 97144311 A

(51) Int. Cl.
*H01Q 1/48* (2006.01)
*H01Q 1/38* (2006.01)

(52) U.S. Cl. ..... 343/846; 343/700 MS; 343/829; 343/702

(58) Field of Classification Search ..... None
See application file for complete search history.

(56) References Cited

U.S. PATENT DOCUMENTS

| | | | | |
|---|---|---|---|---|
| 7,161,543 | B2 | 1/2007 | Cheng et al. | |
| 7,339,536 | B2 | 3/2008 | Hung et al. | |
| 7,525,490 | B2 | 4/2009 | Hung et al. | |
| 7,973,726 | B2 * | 7/2011 | Tseng et al. | 343/702 |
| 8,013,793 | B2 * | 9/2011 | Hung et al. | 343/700 MS |
| 2006/0262016 | A1 * | 11/2006 | Hung et al. | 343/702 |
| 2007/0120753 | A1 * | 5/2007 | Hung et al. | 343/702 |

* cited by examiner

*Primary Examiner* — Trinh Dinh

(74) *Attorney, Agent, or Firm* — Wei Te Chung; Ming Chieh Chang

(57) ABSTRACT

An antenna assembly includes a grounding element with a first edge and a second edge, a first antenna and a second antenna. The first antenna and the second antenna respectively extend from the first side edge and the second side edge of the grounding element, and each includes a connecting element with an opening, a radiating element upward extending from the connecting element and a feeding line. The two openings of the two antennas respectively face two opposite directions. The radiating element of the first antenna is above the second side edge of the grounding element, and the radiating element of the second antenna is above the first side edge of the grounding element.

17 Claims, 3 Drawing Sheets

ANTENNA ASSEMBLY WITH THREE-DIMENSION CONNECTING ELEMENT

RELATED APPLICATIONS

This application is based upon and claims the benefit of priority under 35 U.S.C. 119 based on TAIWAN application no. 97-144311 filed on Nov. 17, 2008, the content of which is incorporated herein by reference.

BACKGROUND OF THE INVENTION

1. Field of the Invention

The present invention relates generally to an antenna assembly, and more particularly to an antenna assembly suitable for building into an electronic device, such as a notebook.

2. Description of the Prior Art

A planar inverted-F antenna is always used inside an electric device. For the electric device trending to be small and thin, the antenna inside the electric device should have the feature of small volume. For that one antenna can not satisfy the need of the electric device, there are always multi antennas in one electric device. U.S. Pat. No. 7,339,536, issued to Hung on Mar. 4, 2008, U.S. Pat. No. 7,525,490, issued to Hung on Apr. 28, and U.S. Pat. No. 7,161,543, issued to Cheng on Jan. 9, 2007, respectively disclose antennas assembly with at least two antennas amounted on a grounding element. However, each of connecting elements disclosed by all the antennas extends along a plane. Thus, the connecting elements are not fit for reduce length of antennas.

Hence, in this art, an antenna assembly to overcome the above-mentioned disadvantages of the prior art should be provided.

BRIEF SUMMARY OF THE INVENTION

A primary object, therefore, of the present invention is to provide an antenna assembly with small structure.

In order to implement the above object, the antenna assembly comprises a grounding element with a first edge and a second edge, a first antenna and a second antenna. The first antenna and the second antenna respectively extend from the first side edge and the second side edge of the grounding element, and each comprises a connecting element with an opening, a radiating element upward extending from the connecting element and a feeding line. The two openings of the two antennas respectively face two opposite directions. The radiating element of the first antenna is above the second side edge of the grounding element, and the radiating element of the second antenna is above the first side edge of the grounding element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
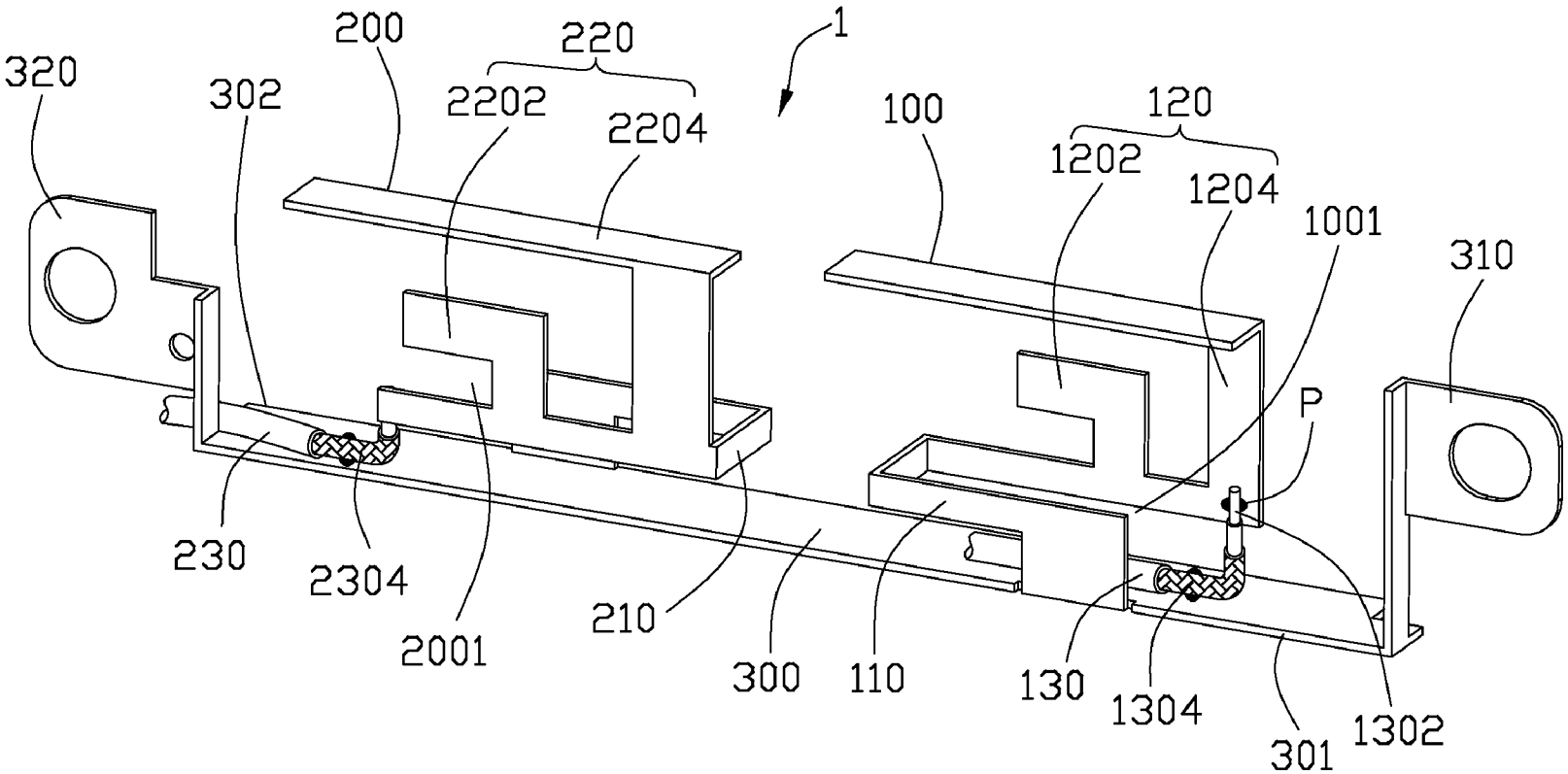
FIG. 1 is a perspective view illustrating a preferred embodiment of an antenna assembly in according with the present invention.
Figure 2:
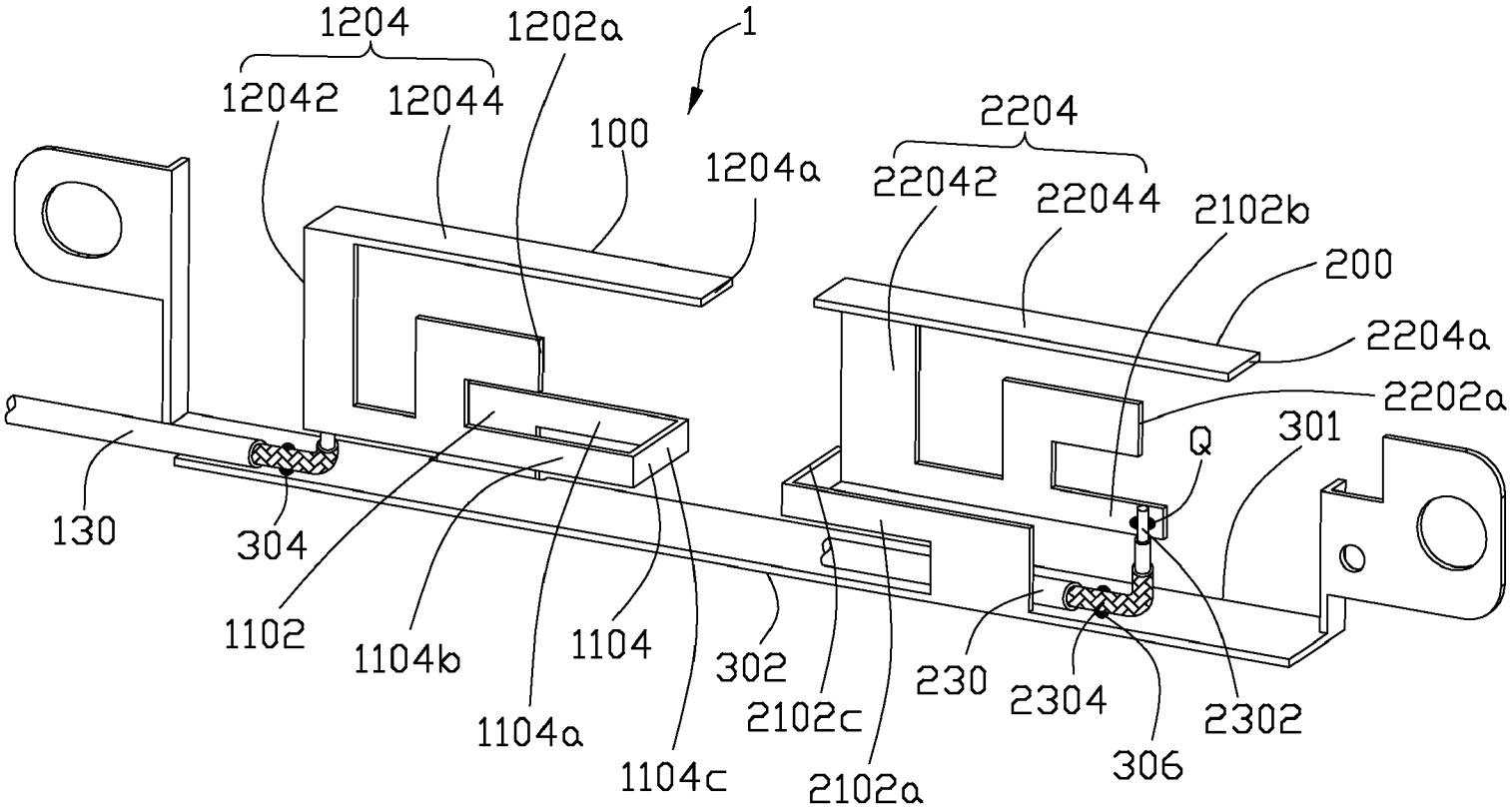
FIG. 2 is a perspective view of FIG. 1, but viewed from another angle.

Reference to FIGS. 1 and 2, an antenna assembly made in according with a preferred embodiment of the present invention is shown. In the embodiment, the antenna assembly 1 is intended for being built in an electric device such as a notebook to transmit signals. The antenna assembly 100 is made by a metal patch and comprises a grounding element 300 which is located on a first plane, a first antenna 100 and a second antenna 200 respectively located on the grounding element 300.

The grounding element 300 comprises a first side edge 301, a second side edge 302 and a first and second setting portion 310, 320 respectively extending from two ends of the grounding element 300. The first and second setting portions 310, 320 are designed according to inner space of the electric device.

The first antenna 100 comprises a first connecting element 110 extending from the first side edge 301 of the grounding element 300, a first radiating element 120 extending from an end of the first connecting element 110, and a feeding line 130. The first connecting element 110 comprises a first side arm 1102 extending from the first side edge 301 of the grounding element 300, and a second side arm 1104 extending from the first side arm 1102. The second side arm 1104 is of U shape which is perpendicular to the grounding element 300 and cross the grounding element 300 to comprise a beginning portion 1104*a* above the first edge 301 of the grounding element 300, an ending portion 1104*b* above the second edge 302 of the grounding element 300, and a connecting portion 1104*c* connecting the beginning portion 1104*a* and the ending portion 1104*b*. For the U shape, the second side arm 1104 form an opening 1001 facing to a first direction. The first radiating element 120 comprises a planar L-shaped first radiating portion 1202 and a tridimensional L-shaped second radiating portion 1204. The two radiating portions 1202, 1204 respectively upward extend from two points on the ending portion 1104*b* along a second direction opposite to the first direction. Thus, the two radiating portions 1202, 1204 are above the ending portions 1104*b* of the connecting element 110. The first radiating portion 1202 is between the second radiating portion 1204 and the connecting element 110 and spaced from the second radiating portion 1204. The second radiating portion 1204 comprises a first radiating arm 12042 extending from the end of the second side arm 1104 of the connecting element 110 and perpendicular to the grounding element 300, and a second radiating arm 12044 extending from the first radiating arm 12042 along the second direction and parallel to the grounding element 300. The first radiating portion 1202 has an end facing to the second direction. The feeding line 130 comprises a first inner conductor 1302 connected to the first connecting element 110 on a first feeding point P, and a first outer conductor 1304 connected to the grounding element 300 on a first grounding point 304. The first feeding point P is located on the joint of the first connecting element 110 and the second radiating portion 1204. The first radiating portion 1202 works on a first higher frequency band and the second radiating portion 1204 operate on a second lower frequency band.

The second antenna 200 comprises a second connecting element 210 extending from the second edge 302 of the grounding element 300, a second radiating element 220 extending from the second connecting element 210, and a second feeding line 230. The second connecting element 210 has the same structure as the first connecting element 110, and the difference is the second connecting element 210 extends from the second edge 302 of the grounding element 300. The second connecting element 210 includes a U-shaped arm 2102, facing to the second direction, with a beginning portion 2102*a*, an ending portion 2102*b*, and a connecting portion 2102*c*. For the U shape, the U-shape arm 2102 forms an opening 2002 facing to the second direction. For the second connecting element 210 extending from the second edge 302 of the grounding element 300, the beginning portion 2102*a* is above the second edge 302 and the tail portion 2102*b* is above the first edge 301. The second radiating element 220 comprises a third radiating portion 2202 being of planar L shape and extending from the ending portion 2102*b*, and a fourth radiating portion 2204 being of three dimensioned L shape. The third radiating portion 2202 and the fourth portion 2204 are both spaced from the end of the second connecting element 210, and the third radiating portion 2202 is nearer to the end of the second connecting element 210 than the fourth radiating portion 2204. The third radiating portion 2202 is located between the fourth radiating portion 2204 and the second connecting element 210 and spaced from the fourth radiating portion 2204. The fourth radiating element 2204 includes a third radiating arm 22042 extending from the joint of the ending portion 2102*b* and the connecting portion 2102*c* and being perpendicular to the grounding element 300, and a fourth radiating arm 22044 extending from the third radiating arm 22042 along the second direction and parallel to the grounding element 300. The third radiating portion 2202 has an end facing to the second direction. The second feeding line 230 comprises a second inner conductor 2302 connected to the end of the second connecting element 210 to form a second feeding point Q, and a second outer conductor 2304 connected to the grounding element 300 on a second grounding point 306. The third radiating portion 2202 works on a third higher frequency band and the fourth radiating portion 2204 operated on a fourth lower frequency band.

Figure 3:
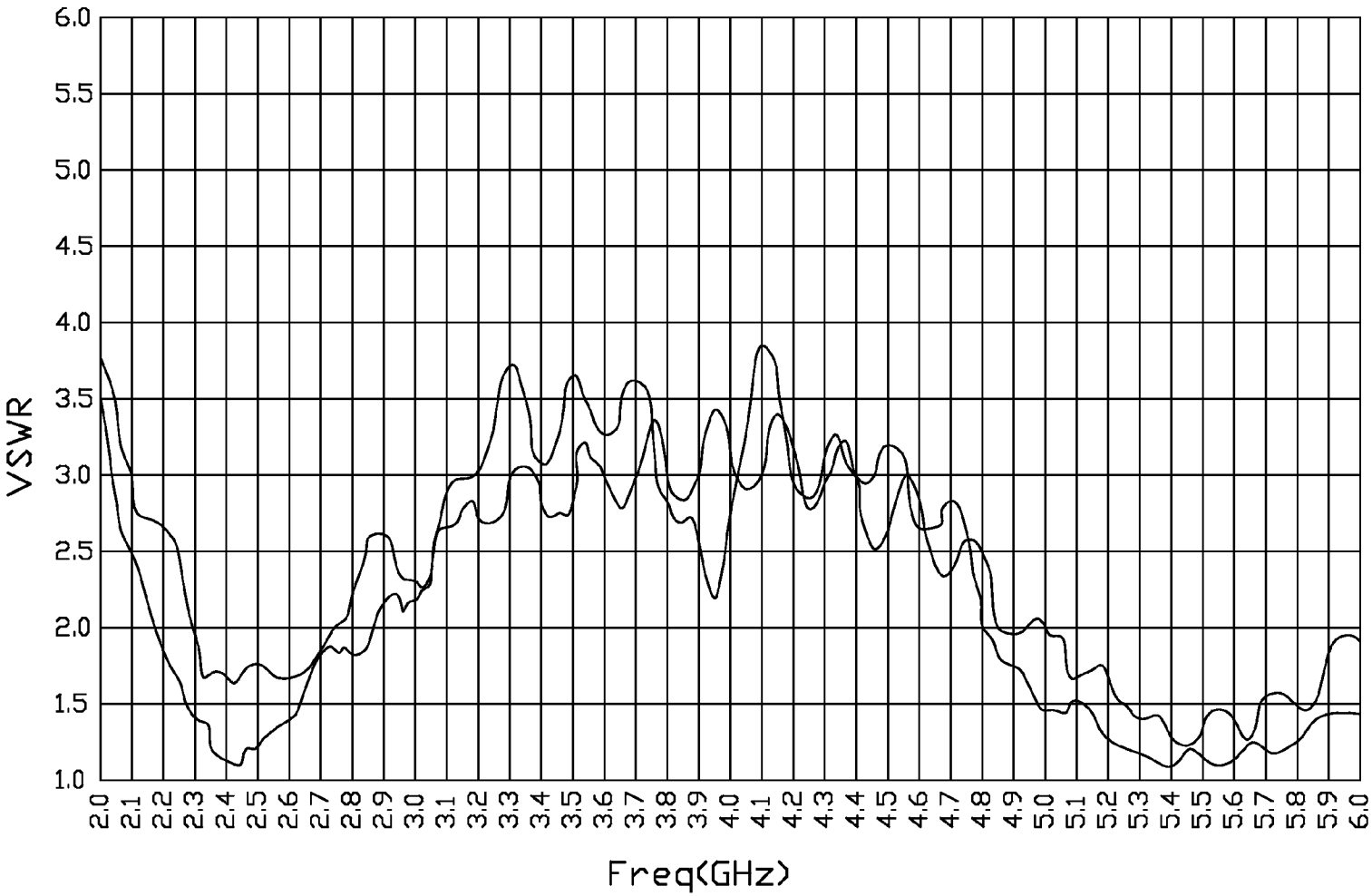
FIG. 3 is a test chart recording for the antenna assembly of FIG. 1, showing Voltage Standing Wave Ratio (VSWR).

Referencing to FIG. 3, a test chart recording for the antenna assembly 1 of this invention, showing Voltage Standing Wave Ratio (VSWR), is shown. It is shown that first antenna 100 and the second antenna 200 cover the frequency bands on 2.3-2.7 GHz and 5.1-5.85GHz. It is obviously that the working frequency bands of the first antenna 100 and the second antenna 200 are complementary to each other, with the first antenna 100 being superior in higher frequency band and the second antenna 200 in lower frequency band. And in this embodiment, ends 1202*a*, 1204*a*, 2202*a*, 2204*a* of the radiating elements 1202, 1204, 2202, 2204 of the two antennas 100, 200 face to the same direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly, comprising:

a grounding element with a first edge and a second edge;

a first antenna; and a second antenna;

wherein the first antenna and the second antenna respectively extend from the first side edge and the second side edge of the grounding element, which each comprises a connecting element with an opening, a radiating element upward extending from the connecting element and a feeding line, said two openings of the two connecting elements of the two antennas respectively face two opposite directions, the radiating element of the first antenna is above the second side edge of the grounding element, and the radiating element of the second antenna is above the first side edge of the grounding element, said connecting elements of the two antennas have the same structure and respectively extend from the first side edge and the second side edge of the grounding element, and each comprises a U-shaped side arm, said U-shaped side arm is perpendicular to the grounding element and comprises a beginning portion, an ending portion with an end and a connecting portion connecting the beginning portion and the ending portion.

2. The antenna assembly as claimed in claim 1, wherein said each radiating element of the two antennas respectively have at least an end, said ends of the radiating elements face the same direction.

3. The antenna assembly as claimed in claim 1, wherein said opening of the first connecting element faces to a first direction, and the opening of the second connecting element faces to a second direction opposite to the first direction.

4. The antenna assembly as claimed in claim 1, wherein said radiating element of the first antenna comprises a planar L-shaped first radiating portion and a tridimensional L-shaped second radiating portion apart from the first radiating portion, which respectively extend from the ending portion of the connecting element and have an end facing to the second direction.

5. The antenna assembly as claimed in claim 4, wherein said radiating element of the second antenna comprises a planar L-shape third radiating portion and a tridimensional L-shaped fourth radiating portion, both of which upward extend from the ending portion of the connecting element and have an end facing to the second direction.

6. The antenna assembly as claimed in claim 5, wherein said first radiating portion extends from the end of the connecting element of the first antenna, and is located between the second radiating portion and the connecting element and apart from the second radiating portion.

7. The antenna assembly as claimed in claim 5, wherein said third radiating portion extends from the joint of the ending portion and the connecting portion of the U-shape side arm of the connecting element of the second antenna, the fourth radiating portion is located between the third radiating portion and the connecting portion of the second antenna and spaced to the third radiating portion, the fourth radiating portion is nearer to the end of the connecting element of the second antenna than the third radiating portion.

8. The antenna assembly as claimed in claim 5, wherein said connecting element and the first radiating portion of the first antenna are perpendicular to the grounding element, said second radiating portion comprises a first radiating arm extending from the connecting element of the first antenna and perpendicular to the grounding element, and a second radiating arm extending along the second direction and parallel to the grounding element.

9. The antenna assembly as claimed in claim 8, wherein said connecting element and the radiating element of the second antenna are both perpendicular to the grounding element, said fourth radiating element comprises a third radiating arm extending from the connecting element of the second antenna and perpendicular to the grounding element, and a fourth radiating arm extending from the third radiating arm along the second direction and parallel to the grounding element.

10. The antenna assembly as claimed in claim 1, wherein each of the feeding line of the first antenna and the second antenna comprises an inner conductor connected to the end of the connecting element and an outer conductor connected to the grounding element.

11. The antenna assembly as claimed in claim 1, wherein said first antenna and second antenna are both dual-band antenna and the first antenna operates on two frequency bands substantially same as the bands operated by the second antenna.

12. An antenna assembly, comprising:

a grounding element having a first side edge and a second side edge different from the first side edge;

a first and second connecting element respectively extending from the two different side edges of the grounding element, which each comprises a U-shaped side arm, each U-shape side arm having an opening and comprising a beginning portion, an ending portion and a connecting portion connecting the beginning portion and the ending portion, said openings of the two connecting elements being opposite to each other;

a first and second radiating element respectively extending from the two ending portions of the two connecting elements along the same direction; and a first and second feeding line respectively connected to the two connecting elements.

13. The antenna assembly as claimed in claim 12, wherein said first and second antenna are both dual-band antenna.

14. The antenna assembly as claimed in claim 12, wherein said two connecting elements have same structure, said ending portion of the first connecting element is above the second side edge of the grounding element, said ending portion of the second element is above the first side edge.

15. An antenna assembly comprising:

an elongated grounding element defining, along a longitudinal direction, opposite first and second longitudinal edges, and opposite first and second halves between said opposite first and second longitudinal edges, wherein the opposite first and second longitudinal edges are essentially symmetrically arranged with each other with regard to a longitudinal centerline of the grounding element while the opposite first and second halves are essentially symmetrically arranged with each other with regard to a transverse centerline of the grounding element which is essentially perpendicular to the longitudinal centerline and intersects said longitudinal centerline at a center point of the grounding element;

a first antenna essentially located on the first half and defining a lower first connecting element extending from the first longitudinal edge, and a first radiating element extending from the first connecting element around the second longitudinal edge; and a second antenna essentially located on the second half and defining a lower second connecting element extending from the second longitudinal edge, and a second radiating element extending from the second connecting element around the first longitudinal edge; wherein the first connecting element and the second connecting element are oppositely and symmetrically arranged with each other with regard to said center point of the grounding element, while said first radiating element and said second radiating element are oppositely and symmetrically arranged with each other only with regard to the longitudinal centerline of the grounding element while similarly arrange with each other under condition of extending along a same direction.

16. The antenna assembly as claimed in claim 15, wherein said first connecting element includes first, second and third consecutive segments located at a middle level, and the first segment is essentially located around the first longitudinal edge and the third segment is located around the second longitudinal edge with the second segment connected therebetween under condition that the first radiating element extends from the third segment; wherein the second connecting element includes first, second and third consecutive sections located around the middle level, and the first section is essentially located around the second longitudinal edge and the third section is located around the first longitudinal edge with the second section connected therebetween under condition that the second radiating element extends from the third section.

17. The antenna assembly as claimed in claim 16, wherein the first radiating element defines a large L-shaped radiating portion extending from the third segment, and a small L-shaped radiating portion under said large L-shaped radiating portion under condition that both said large L-shaped radiating portion and said small L-shape radiating portion direct toward said same direction along the longitudinal direction; the second radiating element defines a large L-shaped radiating section extend from the third section and a small L-shaped radiating section under said large L-shaped radiating section under condition that both said large L-shaped radiating section and said small L-shaped radiating section direct toward said same direction.

* * * * *